US007064647B2

(12) United States Patent
Edmunds et al.

(10) Patent No.: US 7,064,647 B2
(45) Date of Patent: Jun. 20, 2006

(54) FABRICATED AIR CORE REACTOR

(75) Inventors: Howard Ross Edmunds, Roanoke, VA (US); Brian Matthew Alken, Louisville, KY (US); Andrew Phillip, Champaign, IL (US); Christopher McMenamin, Salem, VA (US); Christopher T. Moore, Troutville, VA (US); John Earl Bittner, Troutville, VA (US); Stephen Daniel Nash, Salem, VA (US); Michael L. Miller, Salem, VA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/873,698

(22) Filed: Jun. 22, 2004

(65) Prior Publication Data

US 2005/0280493 A1 Dec. 22, 2005

(51) Int. Cl.
*H01F 27/28* (2006.01)

(52) U.S. Cl. ..... 336/229

(58) Field of Classification Search ..... 336/200, 336/209, 225–229, 234
See application file for complete search history.

(56) References Cited

U.S. PATENT DOCUMENTS 2,378,884 A * 6/1945 Seifert ..... 336/61
2,756,358 A * 7/1956 Johnson ..... 310/180

* cited by examiner

*Primary Examiner*—Tuyen T Nguyen
(74) *Attorney, Agent, or Firm*—Ohlandt, Greeley, Ruggiero & Perle, L.L.P.

(57) ABSTRACT

A method and apparatus for an air core reactor including a plurality of straight members and a plurality of offset members, the plurality of straight and offset members are interconnected to form an orthogonal spiral having an air core therethrough.

13 Claims, 3 Drawing Sheets

FABRICATED AIR CORE REACTOR

BACKGROUND OF INVENTION

1. Field of the Invention

The present disclosure relates to electrical reactors. More particularly, the present disclosure relates to a method and system of a fabricated air core reactor for use in electrical power distribution systems.

2. Description of the Related Art

Air core reactors or power reactors are known in the art. In an air core reactor, the magnetic flux travels in air, maintaining inductance with all currents. Air core reactors are used in electrical power distribution systems for a variety of purposes such as, for example, current limiting reactors, filter reactors, ripple reactors, and shunt reactors.

In power distribution systems having parallel power converters, it is desired that the current between the converters is balanced. It is desired that the currents on each line feeding the converters, including transient and fault currents, are controlled so that other components such as expensive solid state devices are not damaged. The solid state devices can include, but are not limited to, scr's.

Prior methods for controlling the balance of current between the power converters include using load sharing resistors or iron core reactors in each AC line feeding the converters. A disadvantage of the resistors is the IR across them, thereby resulting in an associated watts loss for the system. Thus, the efficiency of the power converter is reduced. The iron core reactors provide good load sharing for rated current but saturate with fault current, thus eliminating the balance affect. The iron core reactors can also add considerable weight to the product.

Another known approach for controlling the current between the parallel power converters includes using an active control system. Such methods involve monitoring each power converter and actively varying each converter's conduction timing. The complexity and costs of designing, installing, maintaining, and servicing such a computer controlled active controlled system can be quite high.

Prior air core reactors have been manufactured using a number of techniques. In general, prior air core reactor designs have included roll formed reactors and edge wound reactors A disadvantage or shortcoming of the both the roll formed and the edge wound reactor designs is that they each require a high level of precision in the manufacturing process to maintain, for example, consistent and accurate spacing between adjacent windings and the sizing and shape of the conductor windings comprising the reactors. Additionally, practical size limitations of the conductors forming these types of reactors limit the ampacity rating of these reactors.

Thus, there exists a need in the art for a fabricated air core reactor that overcomes one or more of the aforementioned deficiencies of prior air core reactors.

BRIEF DESCRIPTION OF THE INVENTION

A method and apparatus for an air core reactor is provided. An air core reactor is provided comprising a plurality of straight members and a plurality of offset members, wherein the plurality of straight and offset members are interconnected to form an orthogonal spiral having an air core therethrough.

The method of providing an air core reactor is provided comprising forming an air core assembly by connecting a first surface of a first straight member to a second surface of a second straight member by a first offset member, the first straight member being in spaced apart relation to the second straight member, and connecting a second surface of the first straight member to a first surface of a third straight member by a second offset member, wherein the first and said second offset members are in spaced apart relation to each other and the air core assembly defines an air core therethrough, and interconnecting a plurality of the air core assemblies to form an orthogonal spiral.

DETAILED DESCRIPTION OF THE INVENTION

Prior air core reactors have been manufactured using a number of techniques. In general, prior air core reactor designs have included roll formed reactors and edge wound reactors such as a roll formed reactor shown in FIG. 1 and an edge wound reactor as shown in FIG. 2, respectively. Such reactors are generally made of aluminum or copper, and include a variety of insulation and bracing designs.

Figure 1:
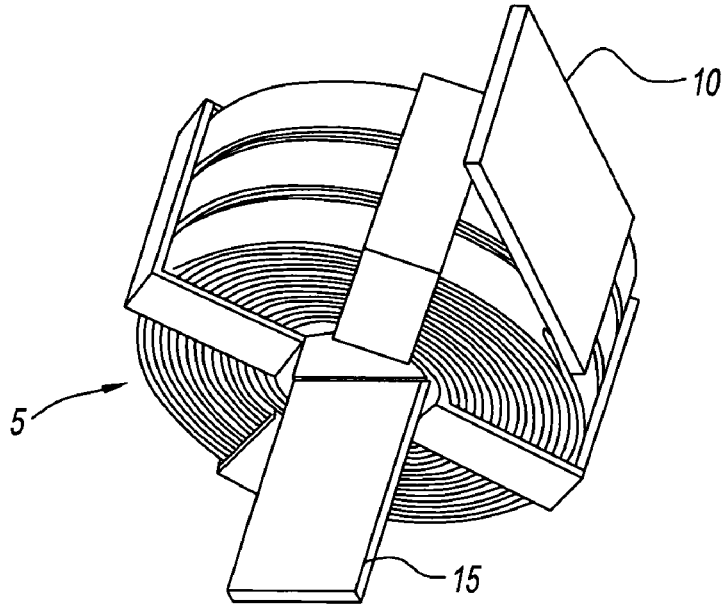
FIG. 1 is a perspective view of a roll formed reactor.
Figure 2:
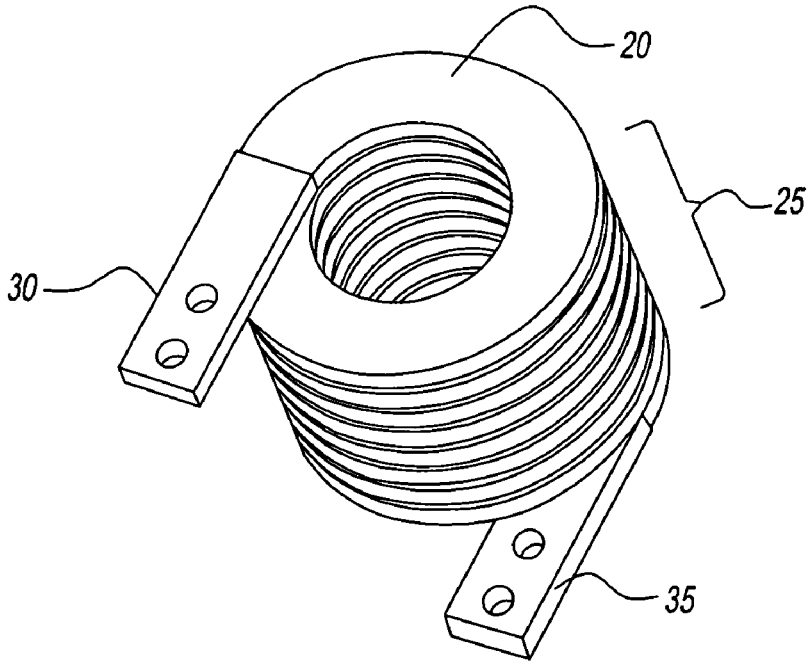
FIG. 2 is a perspective view of an edge wound reactor.

The roll formed reactor of FIG. 1 includes a number of generally flat, roll formed conductors coaxially arranged. The roll formed reactor has terminals 10 and 15 electrically connected to roll formed conductors 5.

The edge wound reactor of FIG. 2 has a generally flat, edge wound conductor 20 configured as coaxial spiral windings 25. The edge wound reactor has terminals 30 and 35 electrically connected to edge wound conductor 20.

Figure 3:
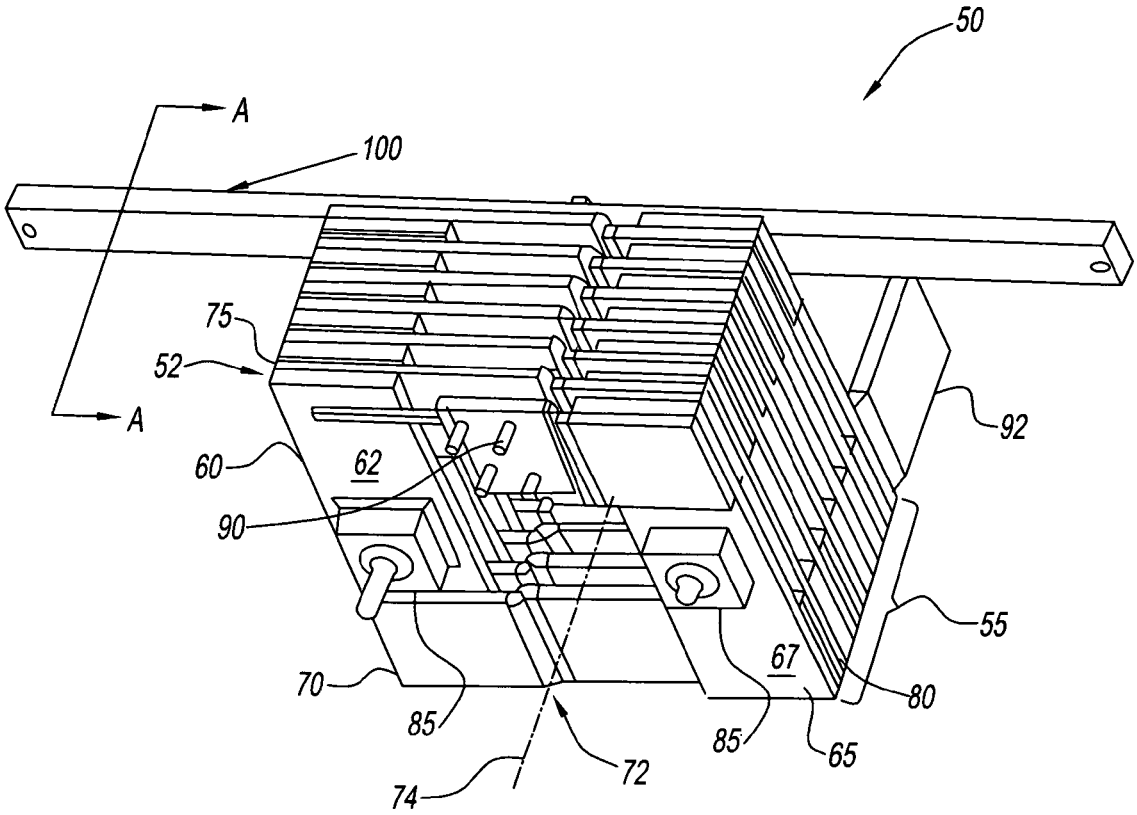
FIG. 3 is a perspective view of a fabricated air core reactor.
Figure 4:
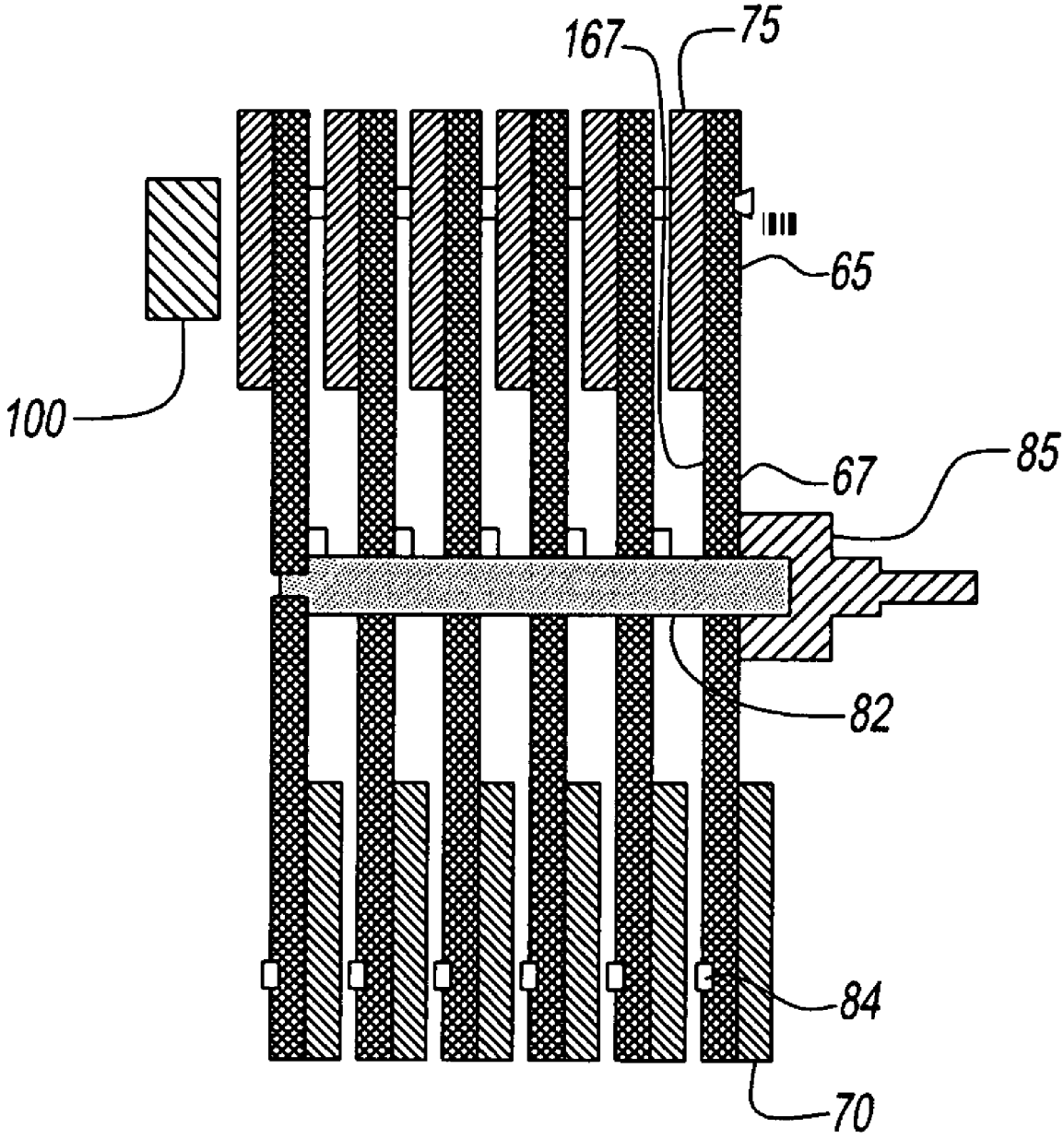
FIG. 4 is a side section view of the air core reactor of FIG. 3 along line A—A.

With reference to FIGS. 3 and 4, there is shown a fabricated air core reactor generally represented by reference numeral 50. Air core reactor 50 has a number of air core assemblies 55. In an aspect hereof, air core assemblies 55 are interconnected to form a substantially orthogonal spiral. Air core assemblies 55 are held at a predetermined spacing by a clamp assembly 85.

In one embodiment, air core assemblies 55 have a generally rectangular shape formed by the interconnection of straight and offset members. The members forming one of the air core assemblies such as, for example, air core assembly 52, are attached together at the ends of the four joined members. Referring to air core assembly 52, it is shown that a first straight member 60, a second straight member 65, a first offset member 70, and a second offset member 75 are connected together to form air core assembly 52. Air core assembly 52 forms, in effect, one turn of the orthogonal spiral of air core reactor 50.

Straight members 60 and 65 are substantially rectangular conductors having planer surfaces. First straight member 60 has a first surface 62 and an second surface (not shown) opposing the first surface 62. Likewise, second straight member 65 has a first surface 67 and a second surface (167) opposing the first surface 67.

In an embodiment hereof, the referenced first surfaces 62, 67 and the second surfaces opposing first surfaces 62, 67 are similarly orientated with reference to fabricated air core assembly 50.

Offset member 70 and offset member 75 are spaced apart from each other. Offset member 70 connects first straight member 60 to second straight member 65. Offset member 75 connects second straight member 65 to third straight member 80. Offset members 70 and 75 each have an offset 72 located therein. The offset of offset members 70 and 75 aligns opposing ends of the offset members along differing parallel longitudinal axis. That is, there is a displacement between the longitudinal axis aligned with the opposing ends of offset members 70 and 75.

In one embodiment hereof, offset member 70 connects a first surface 67 of straight member 65 to the second surface (not shown) of straight member 60. Offset member 75 connects the second surface 167 of straight member 65 to the first surface of third straight member 80.

In this manner, a number of straight and offset members can be interconnected as illustrated in FIGS. 3 and 4 to form fabricated air core reactor 50 having an air core therethrough. Interconnected air core assemblies 55 form a substantially orthogonal spiral structure. The air core through reactor 50 is, in an aspect hereof, aligned about a longitudinal axis 74. The transition from one spiral layer (i.e., turn) to the next is achieved in air core reactor 50 by offsets 72 provided in the offset members.

In an embodiment hereof, the straight members and the offset members interconnected to form the air core reactor 50 are each formed from a rectangular stock or blank of metal. The metal blank may be in the form of an elongated strip of metal.

The metal blank may be rendered into the straight and offset shapes referred to herein by any of a number of techniques and processes known to those skilled in the art.

The metal blank strip of metal is cut to a length appropriate for the dimensions of air core reactor 50. In one aspect hereof, straight members 60, 65, 80 and offset members 70, 75 are cut to the same length from the metal blank. In one embodiment, the straight and offset members are 0.5 inch (H)×4.0 inch (L) aluminum busbars cut to length from an elongated strip of aluminum blank material. The construction material for the straight and offset members may be selected from a number of other conductive materials such as, for example, copper, steel, and various alloys.

The straight and offset members forming the substantially orthogonal spiral of air core reactor 50 are interconnected into the spiral configuration in one embodiment by welds. It is noted that other methods for connecting the straight and offset members together into the desired configuration can be used without departing from the scope of the disclosure herein. For example, the straight and offset members may be connected together by welding, mechanical fasteners, an epoxy, a glue, and any combination thereof.

In one aspect hereof, air core reactor 50 is manufactured using the processes of shearing, punching, forming, and welding the straight and offset members.

In an aspect hereof, the connection method(s) used to connect the straight and offset members should maintain a good electrical conductivity between the connected straight and offset members. Maintaining good electrical conductivity between the interconnected straight and offset members facilitates in the efficient operation of air core reactor 50.

In another aspect hereof, a clamp assembly 85 is included to provide structural support and maintain the spacing between adjacent spiral turns of air core reactor 50. In one embodiment, clamp assembly 85 includes a bolt extending through the straight members on either side of air core reactor 50 and a nut mated to the bolt. The nut and bolt are preferably formed of a non-magnetic material so as to minimize the effect thereof on the operating currents that will traverse air core reactor 50. Clamp assembly 85 can be made of non-magnetic stainless steel. Clamp assembly 85 can be further isolated from air core reactor 50 by the inclusion of an insulator 82. Insulator 82 is provided to provide electrical insulation between the conductive straight and offset members and clamp assembly 85. As shown, clamp assembly 85 may include a bushing(s) and a washer(s) to facilitate the holding strength and integrity of the fabricated air core reactor 50.

Spacers 84 are provided to assist in maintaining the spacing between adjacent spiral layers of air core reactor 50. Maintenance of the predetermined spacing between the adjacent spiral layers of air core reactor 50 contributes to air core reactor 50 having known and reliable operating characteristics. Additionally, spacers 84 provide a measure of turn-to-turn isolating insulation during operation of air core reactor 50 in the instance when operating currents may tend to cause the straight and offset conductive members to vibrate.

For example, various housings and insulating coatings and/or insulating barriers may be applied around and on the air core reactor herein without departing from the scope and spirit of the present disclosure.

In another aspect of the disclosure herein, an input terminal 92 is connected to air core reactor 50, an output terminal 90 is connected air core reactor 50. Input terminal 92 and output terminal 90 provide termination points for the incorporation of air core reactor 50 in a circuit such as a power distribution system. Both input terminal 92 and output terminal 90 provide sufficient contact surfaces for obtaining adequate electrical conductivity between air core reactor 50 and an input and output line (not shown) of a circuit.

In an aspect of the disclosure herein, air core reactor 50 may be mounted in a number of orientations and configurations depending on the application context, including any space and size constraints. A mounting support 100 is illustrated as an example of one of a number of possible ways of supporting air core reactor 50. It is noted that mounting support 100 is preferably electrically isolated from any of the conductive straight and offset members. The insulation between mounting support 100 and other components of air core reactor 50 may include a plastic, a rubber, a polycarbonate resin, and other known electrical insulators.

Therefore, the air core reactor disclosed herein can provide an air core reactor having conductors that are easily manufactured, joined, and electrically insulated. The conductors and the air core rector can be formed using a minimum number of processes such as shearing, punching, forming, and welding. The disclosed air core rector can be used in a number of applications, including an application requiring a high current flow and a low inductance characteristics. The disclosed air core reactor can be designed to accommodate rather limited physical dimensions.

The air core reactor can also have a relatively small physical dimensions such as, for example, a 4 μh, 2500 amps design measuring less than 1 (one) cubic foot and weighing less than 100 pounds.

It should be appreciated that various modifications and changes to the air core reactor disclosed herein may be made without departing from the scope of this disclosure as recited in the accompanying claims.

What is claimed is:

1. An air core reactor comprising:

a plurality of straight members;

a plurality of offset members, wherein said plurality of straight and offset members are interconnected to form an orthogonal spiral having an air core therethrough; and a clamp assembly for maintaining a predetermined turn-to-turn spacing between adjacent turns of said orthogonal spiral.

2. The air core reactor of claim 1, further comprising an insulator for electrically insulating adjacent turns of said orthogonal spiral from each other.

3. The air core reactor of claim 1, wherein said clamp assembly is electrically insulated from said straight and offset members.

4. The air core reactor of claim 1, further comprising an input terminal and an output terminal.

5. The air core reactor of claim 4, wherein said input terminal is connected to a first turn of said air core reactor and said output terminal is connected to a second turn of said air core reactor.

6. The air core reactor of claim 1, wherein said orthogonal spiral is aligned about a longitudinal axis through said air core.

7. The air core reactor of claim 1, wherein said plurality of straight members each have substantially planer surfaces.

8. An air core reactor comprising:

a plurality of substantially rectangular conductors interconnected to form an orthogonal spiral defining an air core therethrough, wherein said orthogonal spiral comprises a plurality of adjacent turns and wherein each turn of said plurality of adjacent turns is defined by four of said plurality of substantially rectangular conductors; and a clamp assembly for maintaining a predetermined turn-to-turn spacing between said plurality of adjacent turns.

9. The air core reactor of claim 8, wherein each of said plurality of substantially rectangular conductors have a planar front surface and a planar rear surface, wherein said planar rear surface of one of said plurality of substantially rectangular conductors is interconnected to said planar front surface of another of said plurality of substantially rectangular conductors.

10. The air core reactor of claim 8, further comprising an insulator for electrically insulating said plurality of adjacent turns from each other.

11. The air core reactor of claim 8, wherein said clamp assembly is electrically insulated from said plurality of substantially rectangular conductors.

12. The air core reactor of claim 8, further comprising an input terminal and an output terminal, said input terminal being connected to a first turn of said orthogonal spiral and said output terminal being connected to a second turn of said orthogonal spiral.

13. The air core reactor of claim 8, wherein said orthogonal spiral is aligned about a longitudinal axis through said air core.

* * * * *